US007402070B1

(12) United States Patent
Wu

(10) Patent No.: US 7,402,070 B1
(45) Date of Patent: Jul. 22, 2008

(54) LATCH MECHANISM WITH SPRING BACK FUNCTION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,496

(22) Filed: Sep. 12, 2007

(51) Int. Cl.
*H01R 13/627* (2006.01)

(52) U.S. Cl. ..... 439/352; 439/152

(58) Field of Classification Search ..... 439/152–158, 439/160

See application file for complete search history.

(56) References Cited

U.S. PATENT DOCUMENTS

| | | | | |
|---|---|---|---|---|
| 6,749,448 | B2 | 6/2004 | Bright et al. | |
| 6,824,416 | B2 | 11/2004 | Di Mascio | |
| 6,851,867 | B2 | 2/2005 | Pang et al. | |
| 6,884,097 | B2 | 4/2005 | Ice | |
| 6,908,323 | B2 | 6/2005 | Ice | |
| 7,052,306 | B2 | 5/2006 | Ishigami et al. | |
| 7,064,959 | B2 | 6/2006 | Kim | |
| 7,077,578 | B2 | 7/2006 | Lee et al. | |
| 7,077,686 | B2 | 7/2006 | Seo et al. | |
| 7,090,523 | B2 | 8/2006 | Shirk et al. | |
| 7,322,845 | B2 * | 1/2008 | Regnier et al. | 439/352 |
| 2004/0023544 | A1 * | 2/2004 | Wu | 439/352 |
| 2004/0023546 | A1 * | 2/2004 | Wu | 439/352 |

* cited by examiner

*Primary Examiner*—Hien Vu
(74) *Attorney, Agent, or Firm*—Wei Te Chung

(57) ABSTRACT

A plug-in module (100) configured for latching engagement with a module receptacle adapted for mounting to a printed circuit board includes opposite sidewalls (11, 21) parallel to each other, and a latch mechanism (8). The latch mechanism includes a pair of sliders (3) and a bail (4). The sliders are sliderably attached to the sidewalls and are configured and arranged to linerear move relative to the sidewalls along a mating direction of the plug-in module. Each slider includes an actuating end for latching with a tab of the module receptacle. The bail is attached to the sidewalls and one ends of the sliders and is configured and arranged such that the rotate motion of the bail results in the linerear movement of the sliders. The bail includes a pair of elastic arms (42) integrally formed therewith and capable of linerear movement relative to the sidewalls along a direction perpendicular to the mating direction to provide elastic restore force to the sliders. The rotation of the bail results in the linerear movement of the elastic arms and the sliders to actuate the actuating ends of the sliders deflecting the latch tabs of the module receptacle to separate the plug-in module from the module receptacle.

14 Claims, 6 Drawing Sheets

LATCH MECHANISM WITH SPRING BACK FUNCTION

BACKGROUND OF THE INVENTION

1. Field of the Invention

The present invention generally relates to a plug-in module, and more particularly to a plug-in module used for high-speed transmission.

2. Description of Related Art

SFP (Small Form-factor Pluggable), X-SFP and QSFP are all modules for fiber optic transmission or ordinary signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle.

When such a module embedded in a system fails, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it. Additionally, a user should not attempt to pull on cables of the module in order to try and remove a failed module or else the user might cause damage thereto.

A typical release method for a pluggable module is to push in on the module itself and then pull out on the module to release it from a cage assembly or module receptacle. It has been determined than this method is not very reliable with users complaining of the difficulty in removing pluggable modules in such manner. Users often complain that traditional methods offer little leverage in getting a sufficient grip on the module when attempting to pull it out of a module receptacle. Another complaint is that traditional actuators used to remove modules are inaccessible or invisible. Other users complain than once released by the traditional method, it is difficult to withdraw the module out of its cage or module receptacle.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, for returning to original position, the latch mechanisms usually adopt bias elements which provide elastic restore force to the latch mechanism. The present invention provides a plug-in module with an improved latch mechanism having self spring back function.

BRIEF SUMMARY OF THE INVENTION

Accordingly, an object of the present invention is to provide a plug-in module with improved latch mechanism with self spring back function.

In order to achieve the above-mentioned object, a plug-in module configured for latching engagement with a module receptacle adapted for mounting to a printed circuit board comprises opposite sidewalls parallel to each other, and a latch mechanism. The latch mechanism comprises a pair of sliders and a bail. The sliders are sliderably attached to the sidewalls and are configured and arranged to linerear move relative to the sidewalls along a mating direction of the plug-in module. Each slider comprises an actuating end for latching with a tab of the module receptacle. The bail is attached to the sidewalls and one ends of the sliders and is configured and arranged such that the rotate motion of the bail results in the linerear movement of the sliders. The bail comprises a pair of elastic arms integrally formed therewith and is capable of linerear movement relative to the sidewalls along a direction perpendicular to the mating direction to provide elastic restore force to the sliders. The rotation of the bail results in the linerear movement of the elastic arms and the sliders to actuate the actuating ends of the sliders deflecting the latch tabs of the module receptacle to separate the plug-in module from the module receptacle.

Other objects, advantages and novel features of the invention will become more apparent from the following detailed description of the present embodiment when taken in conjunction with the accompanying drawings.

DETAILED DESCRIPTION OF THE INVENTION

Figure 1:
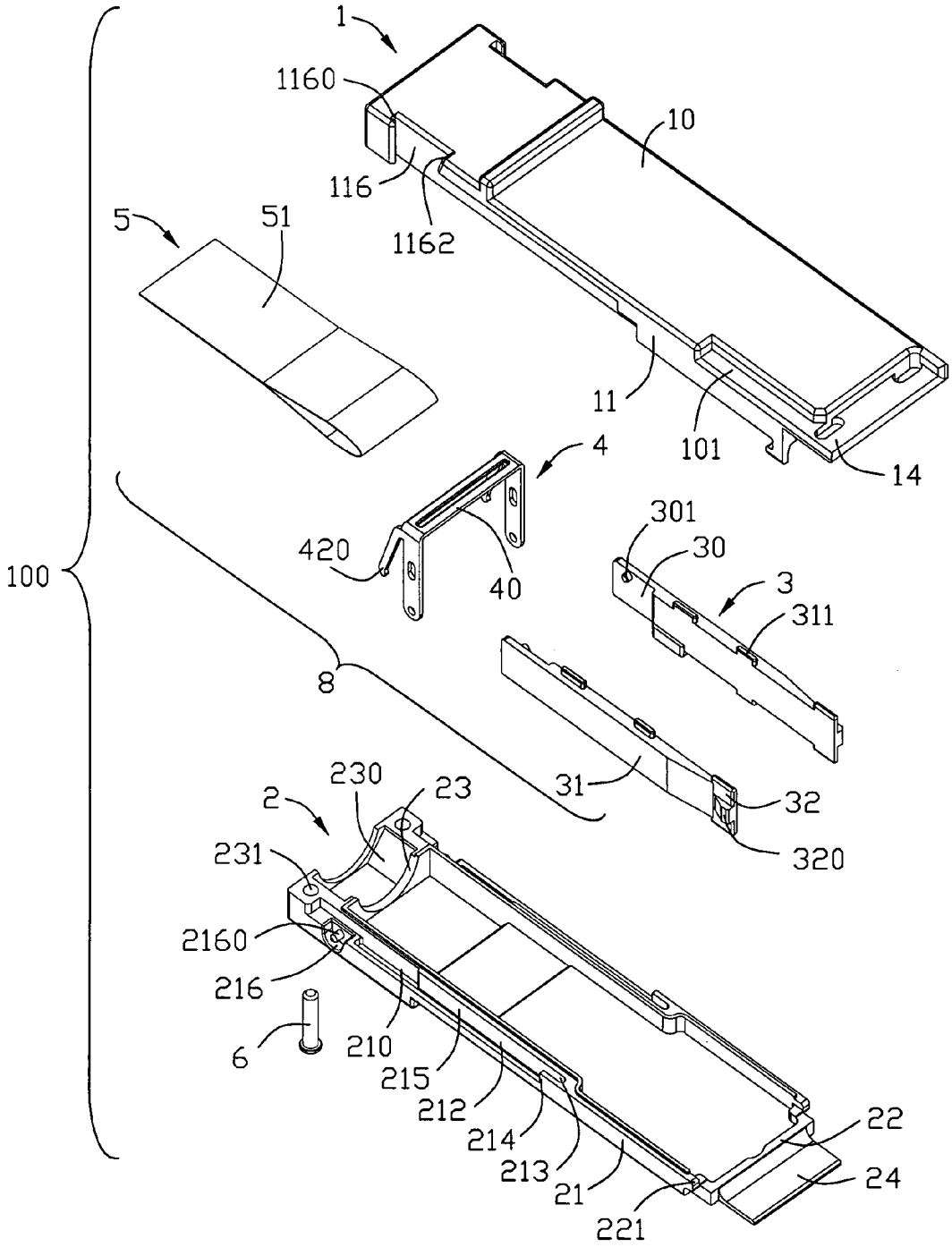
FIGS. 1-2 are exploded, perspective views of a plug-in module in accordance with the present invention and viewed from different aspects.

Reference will now be made to the drawing figures to describe the present invention in detail.

Figure 2:
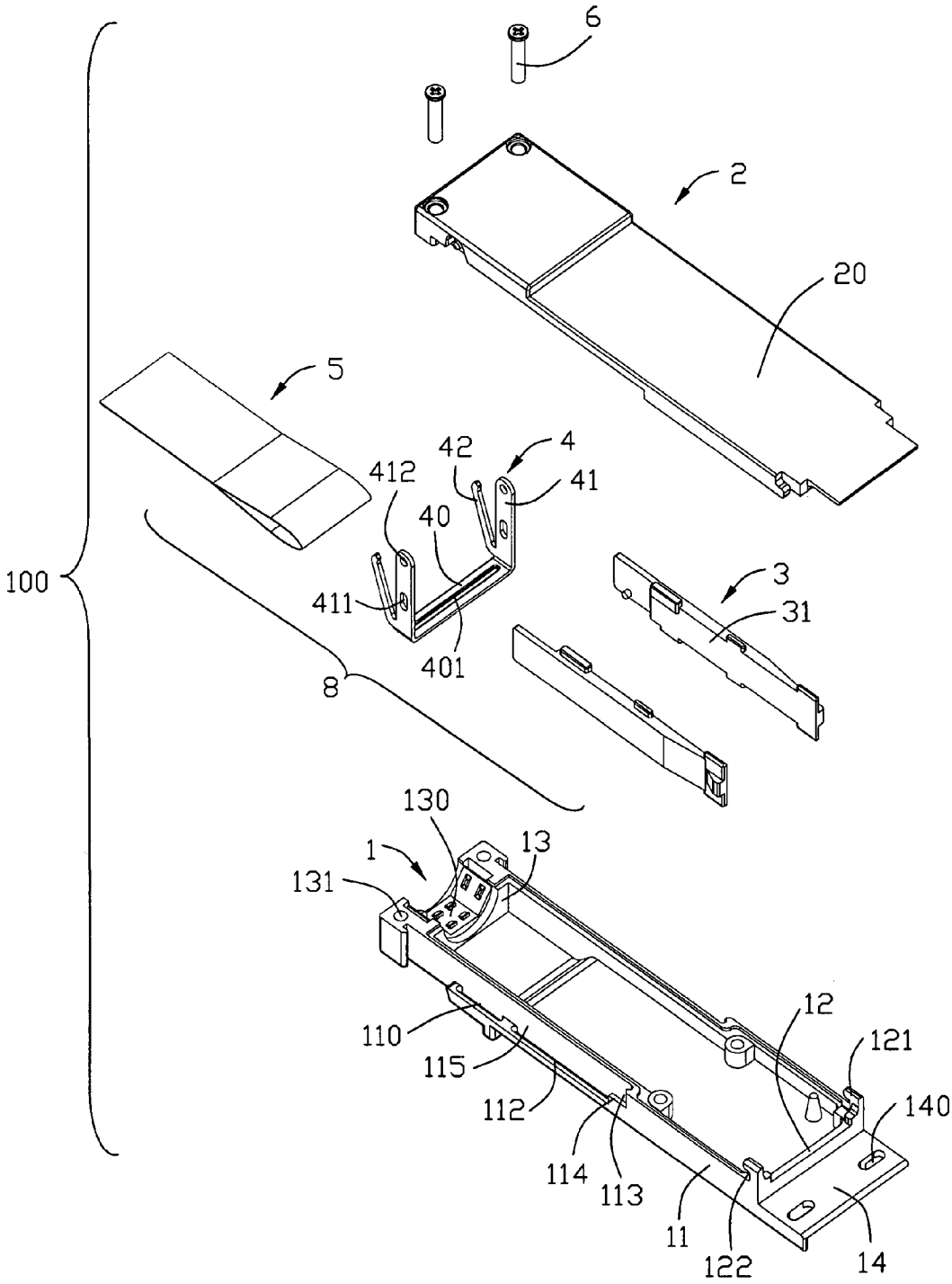

Referring to FIGS. 1-2, a plug-in module 100 in accordance with the present invention comprises a base 2, a cover 1 assembled with the base 2 to form a die case housing 7, and a latch mechanism 8 assembled to the base 2 and the cover 1 for unplugging the plug-in module 100 from a module receptacle (not shown) conveniently. The latch mechanism 8 comprises a pair of sliders 3 assembled to the base 2 and the cover 1, a bail 4 assembled to the base 2, the cover 1, and the sliders 3 for actuating the sliders 3 linearly move and providing elastic restoring force to the sliders 3, and a pull tape 5 made from soft insulative material and assembled to the bail 4 for unplugging the plug-in module 100 from the module receptacle conveniently. In the preferred embodiment, the plug-in module 100 is a QSFP (Quad Small Form-factor Pluggable) module in accordance with Revision 1.0 of the QSFP Transceiver specification released on Dec. 1, 2006. However, the plug-in module 100 also can be other types of modules without betray the spirit of the present invention.

The cover 1 is elongated and comprises a step-shape flat board 10, a pair of first sidewalls 11 and opposite first front and rear walls 12, 13 respectively extending downwardly from the flat board 10. Further, the flat board 10 extends forwardly beyond the first front wall 12 to form a first flange 14. An L-shape cutout 101 is recessed downwardly from upper surface of the flat board 10 and occupies one corner of the flat board 10 for preventing excessive insertion of the plug-in module 100. A pair of elliptic-shape holes 140 are spaced arranged on the first flange 14. The first rear wall 13 defines a semicircular first exiting opening 130 for the existence of a cable and a pair of first screw-receiving holes 131 at opposite sides of the exiting opening 130. A pair of L-shape tip ends 121 are formed with opposite ends of the first front wall 12, thus, forming a pair of engaging recesses 122 between the tip ends 121 and the first sidewalls 11. A through slot 116 is defined through a rear portion of each first sidewall 11. A guiding channel 1160 is formed between the first sidewall 11 and the flat board 10 and locates behind the through slot 116 to communicate with the through slot 116. The first sidewall 11 forms an inclined edge 1162 formed at forward end of the through slot 116. In addition, Outer and lower sides of each first sidewall 11 are partially cut to form a first receiving channel 115 which communicates with the through slot 116 and inner and upper parts of the first sidewall 11 is left. A rear sliding slit 110, a front sliding slit 112 spaced from the rear sliding slit 110 are recessed upwardly into the upper part, and a front receiving space 113 communicating with the front sliding slit 112 is formed between the inner part and an L-shape outer part 114 of the first sidewall 11.

The base 2 comprises a step-shape flat board 20, a pair of second sidewalls 21, and opposite second front and rear walls 22, 23 respectively upwardly extending from the flat board 20. Further, the flat board 20 extends forwardly beyond the second front wall 22 to form a second flange 24 parallel spaced from the first flange 14. The second rear wall 23 defines a semicircular second exiting opening 230 and a pair of second screw-receiving holes 231 respectively corresponding to the first exiting opening 230 and the first screw-receiving holes 131. Lower and outer parts of each second sidewall 21 are partially cut to form a second receiving channel 215 and thinner inner part and lower part of the second sidewall 21 are left. A rear sliding slit 210 and a front sliding slit 212 are recessed downwardly from lower part of the second sidewall 21, and a front receiving space 213 is formed between the inner part and an L-shape outer part 214 of the second sidewall 21. A semicircular recess 216 is recessed downwardly from the second sidewall 21 and locates behind the rear sliding slit 210. A pin 2160 is formed in the recess 216.

The sliders 3 are die casted from metal material and each slider 3 comprises a main portion 31 formed with two pairs of protrusions 311 on upper and lower edges thereof, a thinner rear cooperating portion 30 formed with a column 301 on upper par thereof, and an enlarged actuating end 32 at forward end of the main portion 31 with a latching projection 320 formed on outer surface thereof.

The bail 4 is of n-shape and comprises a transverse operating portion 40 with a slit 401 defined therein, a pair of vertical cooperating arms 41 downwardly from opposite edges of the operating portion 40, and a pair of elastic spring arms 42 rearwardly and downwardly extending from rear edges of the pair of cooperating arms 41 to form an acute angle therebetween. Each spring arm 42 forms a distal end 420. A pair of upper elliptical-shape cooperating slots 411 and a pair of lower cooperating holes 412 are respectively defined in the cooperating arms 41.

The pull tape 5 is a soft belt with a certain width and comprises opposite ends.

Figure 3:
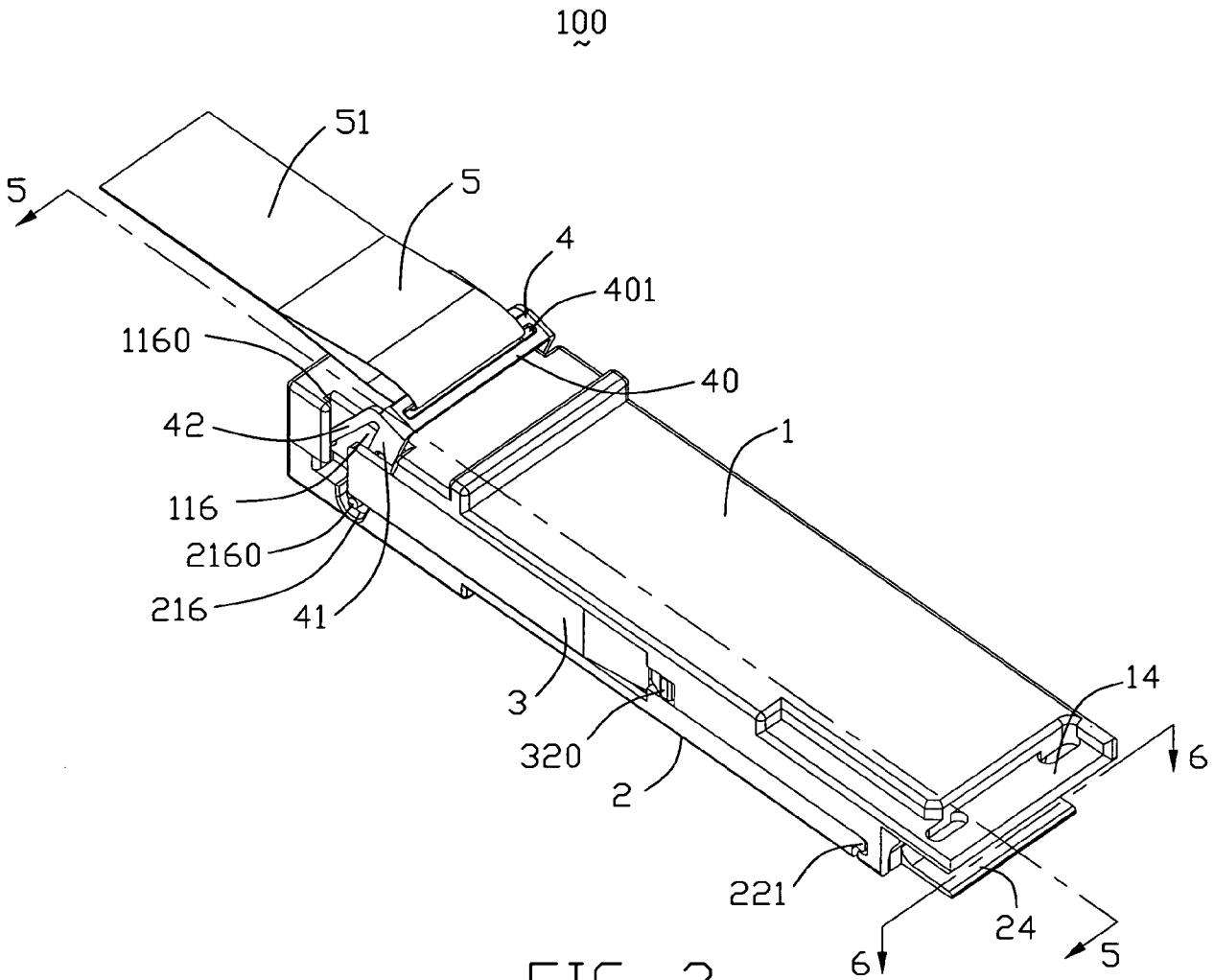
FIGS. 3-4 are partially assembled views of FIGS. 1-2.
Figure 4:
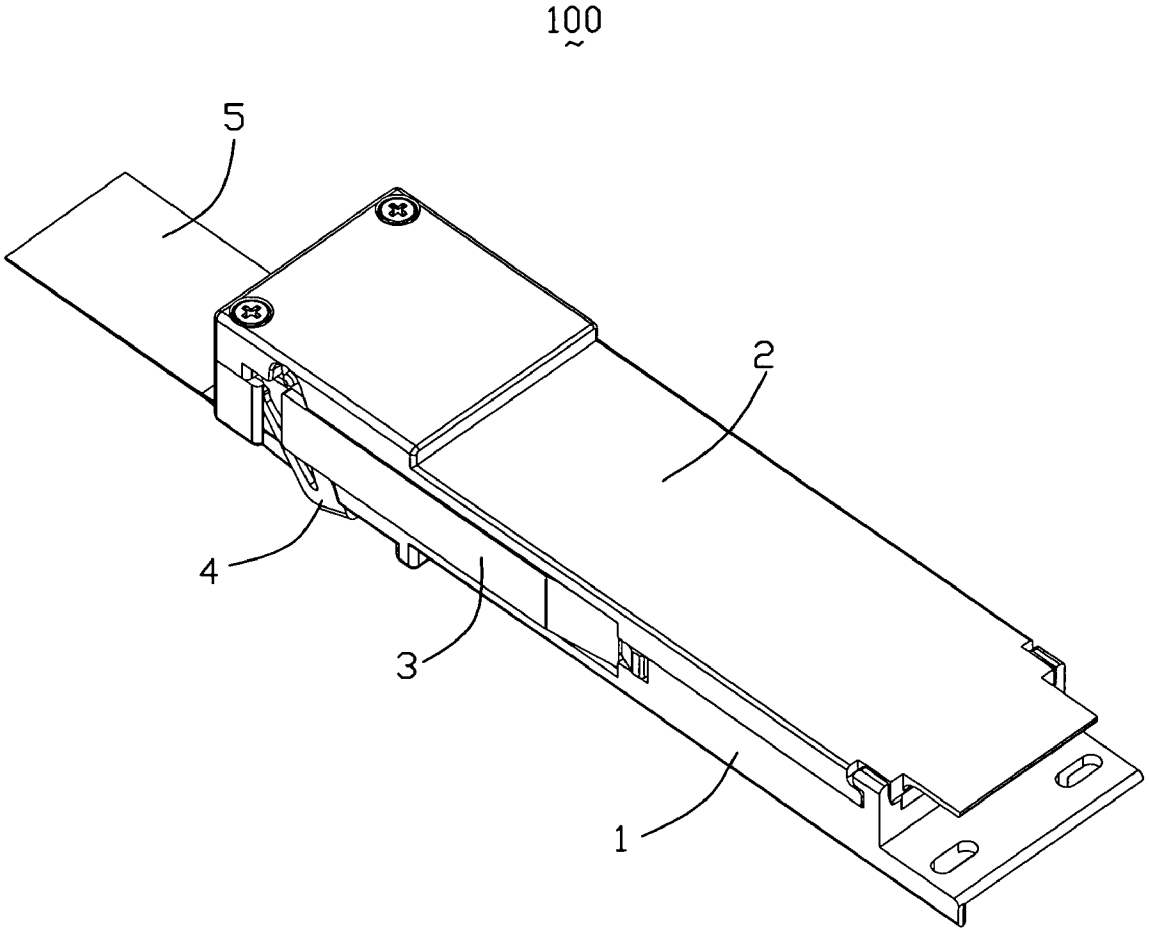
Figure 5:
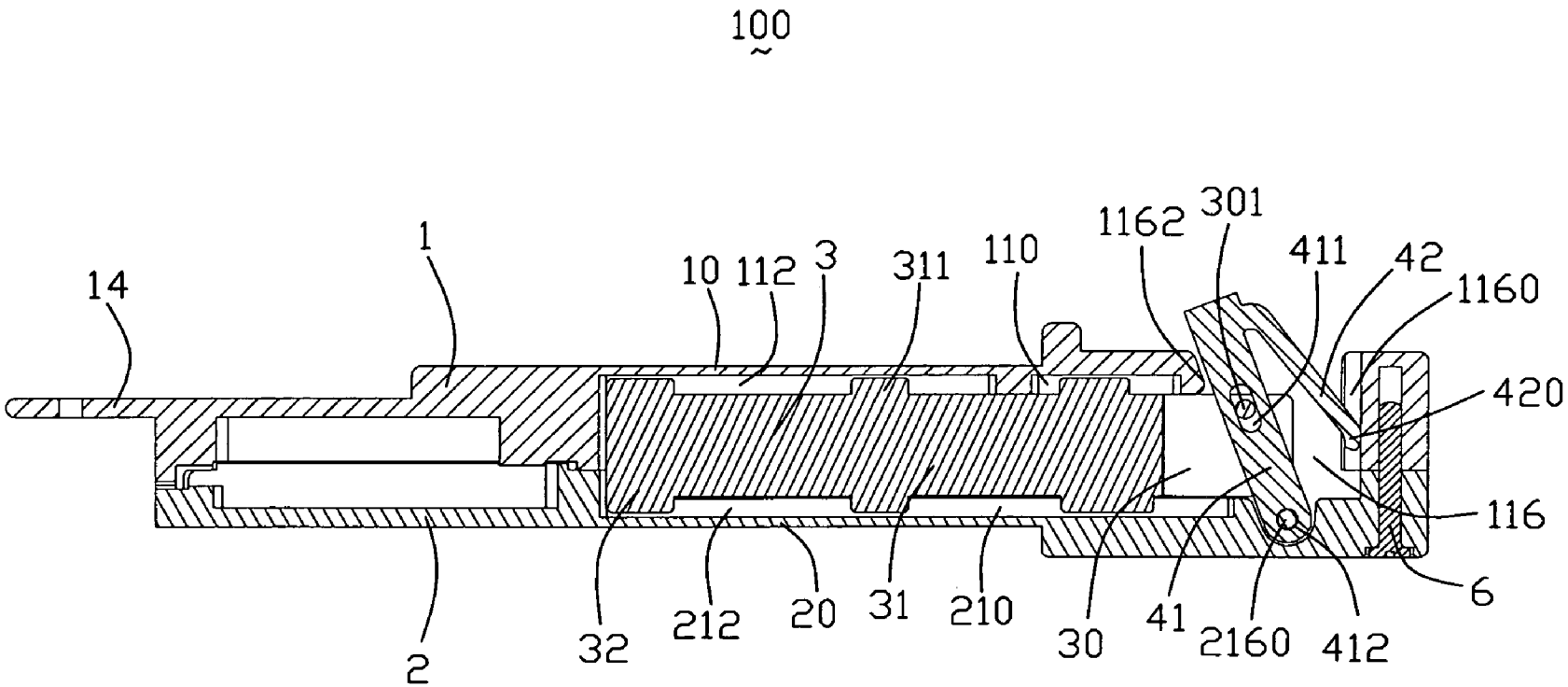
FIGS. 5-6 are cross-section views of the plug-in module taken along lines 5-5 to 6-6 of FIG. 3.
Figure 6:
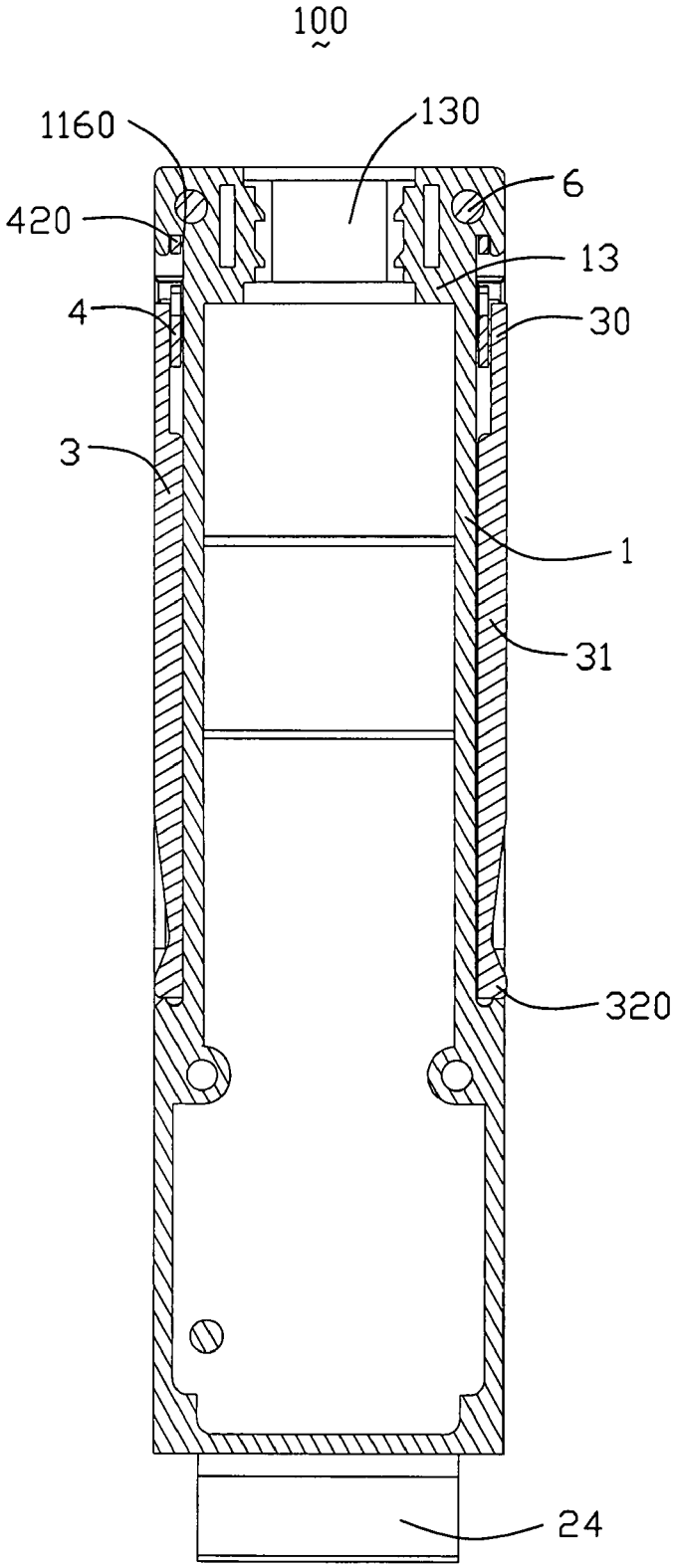

In assembly, referring to FIGS. 3-4 in conjunction with FIGS. 5-6, the bail 4 is firstly assembled to the cover 1 with the operating portion 40 across the flat board 10 and the cooperating arms 41 and the elastic spring arms 42 mainly received in the through slot 116. Now, the distal ends 420 of the spring arms 42 are received in the guiding channels 1160 and elastically abutting against lower inner edges of the guiding channels 1160 to force the front edges of the cooperating arms 41 abutting against the inclined edges 1162. The distal ends 420 of the elastic arms 42 are capable of sliding along the guiding channels 1160. Then, the sliders 3 are assembled to the cover 1 with upper sections of the cooperating portions 30, the main portions 31 and the actuating ends 32 received in the first receiving channel 115 and the first receiving spaces 113. The columns 301 are received in the cooperating slots 411 can capable of sliding in the cooperating slots 411. The protrusions 311 are sliderably respectively received in the front and rear sliding channels 110, 112 and the outer surfaces of the sliders 3 are substantially coplanar with that of the first sidewalls 11. The pull tape 5 protrudes through the slit 401 then the opposite ends thereof are sticked to each other to form a handling portion 51 for being pulled by an operator to pull the bail 4 rearwardly move then to actuate the sliders 3 rearwardly move to separate from the module receptacle. The cover 1, and the sliders 3, the bail 4 and the pull tape 5 are assembled to the base 2 with forward tip ends 221 of the second sidewalls 21 inserted into the engaging recesses 122 of the cover 1 and the cover 1 rotating downwardly until combined with the base 2. The lower sections of the cooperating portions 30, the main portions 31 and the actuating ends 32 received in the second receiving channel 115 and the second receiving spaces 113. The protrusions 311 are sliderably respectively received in the front and rear sliding channels 210, 212 and the outer surfaces of the sliders 3 are substantially coplanar with that of the second sidewalls 21. Lower ends of the cooperating arms 41 are received in the recesses 216 with the pins 2160 received in the cooperating holes 412 and capable rotating relative to the cooperating holes 412. Thus, the latching projections 320 are exposed in the space formed by the outer parts 114, 214. A pair of screws 6 protrude through the first and second screw-receiving holes 131, 231 to fasten the base 2 and the cover 1 together. In addition, before assembling the cover 1 to the base 2, a printed circuit board (not shown) with conductive pads on front and rear ends thereof and a cable (not shown) having a plurality of conductors may be assembled to the base 2 then to the cover 1, with front end of the printed circuit board disposed between the first and second flanges 14, 24 and the conductors of the cable electrically connecting with the conductive pads of the printed circuit board and exiting from the first and second exiting openings 130, 230.

After the above assembly, the plug-in module 100 is achieved. When removing the plug-in module 100 from the module receptacle, operator may grasp the handling portion 51 of the pull tape 5 and exert a rearward force to the pull tape 5 or grasp the operating portion 40 of the bail 4 and exert a rearward force to the operating portion 40. The Thus, the distal ends 420 of the spring arms 42 may slide downwardly along the guiding channels 1160 and the bail 4 rotate along counterclockwise direction relative to the pins 2160. With the movement of the bail 4, the columns 301 slide along the cooperating slots 411 to cause the pair of sliders 3 rearwardly move. The protrusions 311 slide in the sliding channels 110, 112, 210, 212. With the rearward movement of the sliders 3, the latching projections 320, which originally latch with tabs of the module receptacle, push the tabs outwardly move to disengage the plug-in module 100 from the module receptacle. When release the pulling force to the pull tape 5 or the bail 4, the compressed spring arms 42 may slide in the guiding channels 1160 along opposite direction to release the bail 4 to rotate along clockwise direction relative to the pins 2160, thus, the sliders 3 forwardly move to its original positions.

The self spring back bail 4 simplifies the structure of the plug-in module 100 and the omitted bias elements causes the cost of the plug-in module 100 reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug-in module configured for latching engagement with a module receptacle adapted for mounting to a printed circuit board, comprising:

opposite sidewalls parallel to each other; and a latch mechanism comprising:

a pair of sliders sliderably attached to the sidewalls and being configured and arranged to linerear move relative to the sidewalls along a mating direction of the plug-in module, each slider comprising an actuating end adapted for latching with a tab of the module receptacle;

a bail attached to the sidewalls and one ends of the sliders and being configured and arranged such that the rotate motion of the bail results in the linerear movement of the sliders, the bail comprising a pair of elastic arms integrally formed therewith and capable of linerear movement relative to the sidewalls along a direction perpendicular to the mating direction to provide elastic restore force to the sliders; and wherein the rotation of the bail results in the linerear movement of the elastic arms and the sliders to actuate the actuating ends of the sliders deflecting latch tabs of the module receptacle to separate the plug-in module from the module receptacle;

wherein the bail comprises an operating portion across the pair of sidewalls, a pair of cooperating arms downwardly from the operating portion and cooperating with the sliders and the sidewalls, and the pair of elastic arms slantly extending from the cooperating arms to form acute angles with the cooperating arms;

wherein each sidewall defines a guiding channel along vertical direction, and wherein each elastic arm forms a distal end received in the guiding channel and is capable of sliding in the guiding channel along said vertical direction which is perpendicular to the mating direction;

wherein the plug-in module further comprises a base and a cover respectively comprising first and second sidewalls, and wherein the sliders and the bail are respectively sliderably and rotatably attached to the first and second sidewalls of the base and the cover.

2. The plug-in module as claimed in claim 1, wherein each elastic arm extends rearward and downward from upper edge of corresponding cooperating arm.

3. The plug-in module as claimed in claim 1, further comprising a pull tape tied to the operating portion of the bail for being pulled to actuate the bail rotate and the sliders linear move.

4. The plug-in module as claimed in claim 3, wherein the pull tape is soft, and the bail and the sliders are stiff.

5. The plug-in module as claimed in claim 1, wherein each cooperating arm of the bail defines a cooperating slot, and wherein each slider forms a column received in the cooperating slot and capable of sliding in the cooperating slot.

6. The plug-in module as claimed in claim 5, wherein each cooperating arm of the bail defines a cooperating hole below the cooperating slot, and wherein each sidewall forms a pin to rotatably received in the cooperating hole.

7. The plug-in module as claimed in claim 6, wherein each sidewall defines a recess in which the pin is received, and wherein the free end of each cooperating arm of the bail is received in the recess with the pin received in the cooperating hole.

8. The plug-in module as claimed in claim 1, wherein the cooperating arms of the bail are rotatably assembled to the base, and wherein the spring arms of the bail are assembled to the cover.

9. The plug-in module as claimed in claim 1, wherein the base and the cover respectively define a pair of first sliding slits and a pair of second sliding slits in first and second sidewalls, and wherein each slider forms at least one pair of protrusions received in opposite first and second sliding slits and capable of sliding along the first and second sliding slits.

10. A plug-in module configured to be selectively received within a module receptacle having opposite sidewalls and a latch mechanism configured to interact with corresponding structure of the module receptacle, the latch mechanism comprising:

a pair of sliders sliderably attached to corresponding sidewalls and configured and arranged such that the sliders are capable of linerear movement relative to the sidewall along a mating direction of the plug-in module, each slider comprising an actuating end adapted for latching with a tab of the receptacle module; and a bail cooperating with the sliders and comprising an operating portion for being pulled to actuate the bail to rotate, a pair of cooperating arms respectively cooperating with the sliders to cause linear movement of the sliders to actuating the actuating ends of the sliders separating from the tabs of the module receptacle, and a pair of elastic arms integrally formed with at least one of the cooperating portion and the pair of cooperating arms and being capable of being compressed with the rotation of the bail for providing elastic restore force to the bail and the sliders after the separation of the plug-in module from the module receptacle;

wherein the pair of elastic arms of the bail rearward and downwardly extend from upper edges of the pair of cooperating arms of the bail;

wherein each sidewall defines a guiding channel along vertical direction, and wherein each elastic arm forms a distal end received in the guiding channel and is capable of sliding in the guiding channel along said vertical direction which is perpendicular to the mating direction;

wherein the plug-in module further comprises a base and a cover respectively comprising first and second sidewalls, and wherein the sliders and the bail are respectively sliderably and rotatably attached to the first and second sidewalls of the base and the cover.

11. The plug-in module as claimed in claim 10, further comprising a pull tape tied to the operating portion of the bail for being pulled to separate the plug-in module from the module receptacle.

12. A plug-in module configured to be selectively received within a module receptacle having opposite sidewalls and a latch mechanism configured to interact with corresponding structure of the module receptacle, comprising:

a casing including a base and a cover having sidewalls;

the latch mechanism including:

at least one slider sliderably mounted upon at least one of said base and said cover, and configured and arranged such that the sliders are capable of linerear movement relative to the sidewall along a mating direction of the plug-in module, the slider comprising an inner end adapted to be located adjacent to a tab of the receptacle module; and a pivotal bail cooperating with the sliders and comprising an operating portion for being pulled to actuate the bail to rotate, at least one cooperating arm pivotally linked to an outer end of the slider to cause linear movement of the slider for actuating the inner ends of the slider for releasing the tab of the module receptacle; wherein the bail defines two opposite ends with a pivot axis of said bail located around one end of the cooperating arm, and with the operating portion essentially located around the other end of the cooperating arm, under a condition that the outer end is pivotally linked to a position of said cooperating arm between said two opposite ends;

wherein said bail is equipped with an elastic arm extending rearward and downward from the cooperating arm to constantly urge the operating portion to be located in a more relaxed position for assuring no inadvertent releasing due to the slider;

wherein one of the sidewalls of the cover defines a guiding channel along vertical direction and wherein the elastic arm forms a distal end received in the guiding channel and is capable of sliding in the guiding channel along said vertical direction which is perpendicular to the mating direction.

13. The plug-in module as claimed in claim 12, wherein the operating portion is equipped with a pull tab.

14. The plug-in module as claimed in claim 13, wherein said operating portion defines a slot through which the pull tab extends.

* * * * *